US010266980B2

(12) United States Patent
Kwon et al.

(10) Patent No.: US 10,266,980 B2
(45) Date of Patent: Apr. 23, 2019

(54) WASHING MACHINE AND CONTROL METHOD THEREOF

(71) Applicant: LG ELECTRONICS INC., Seoul (KR)

(72) Inventors: Sunku Kwon, Seoul (KR); Hwanjin Jung, Seoul (KR); Sanghyun Lee, Seoul (KR); Bonkwon Koo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 405 days.

(21) Appl. No.: 14/628,956

(22) Filed: Feb. 23, 2015

(65) Prior Publication Data

US 2015/0240405 A1 Aug. 27, 2015

(30) Foreign Application Priority Data

Feb. 21, 2014 (KR) ..... 10-2014-0020663

(51) Int. Cl.
*D06F 33/02* (2006.01)
*D06F 39/08* (2006.01)

(52) U.S. Cl.
CPC ..... *D06F 33/02* (2013.01); *D06F 39/085* (2013.01); *D06F 39/087* (2013.01); *D06F 39/083* (2013.01); *D06F 2202/085* (2013.01); *D06F 2202/10* (2013.01); *D06F 2202/12* (2013.01); *D06F 2204/065* (2013.01); *D06F 2204/08* (2013.01); *D06F 2204/086* (2013.01); *D06F 2212/02* (2013.01)

(58) Field of Classification Search
CPC .... D06F 33/02; D06F 39/003; D06F 2202/10; D06F 2202/12; D06F 35/006
USPC ..... 8/137, 158, 159, 149.3, 147; 68/12.02, 68/12.04, 12.05, 207, 17 R, 13 R, 12.19, 68/12.16, 12.01, 12.21, 12.23
See application file for complete search history.

(56) References Cited

U.S. PATENT DOCUMENTS 4,986,093 A * 1/1991 Pastryk ..... D06F 39/02 68/13 R
7,421,752 B2 * 9/2008 Donadon ..... D06F 39/003 8/158
8,674,242 B2 * 3/2014 Kim ..... D06F 37/12 177/1

(Continued)

FOREIGN PATENT DOCUMENTS

EP 2175061 A1 4/2010
JP 2012205629 A 10/2012

(Continued)

*Primary Examiner* — David G Cormier
*Assistant Examiner* — Thomas Bucci
(74) *Attorney, Agent, or Firm* — Dentons US LLP

(57) ABSTRACT

A washing machine and a control method thereof including supplying wash water into a space defined between an outer tub and an inner tub without wetting the laundry placed in the inner tub, operating the circulation pump to supply water from the outer tub to the inner tub, measuring a current value supplied to a circulation pump, stopping the operation of the circulation pump based on the measured current value, and calculating the amount of wash water supplied by the circulation pump based on the number of rotations of the circulation pump integrated until that time.

20 Claims, 4 Drawing Sheets

(56) References Cited

U.S. PATENT DOCUMENTS

| | | | | |
|---|---|---|---|---|
| 2004/0006831 | A1* | 1/2004 | Kim | D06F 13/08 8/159 |
| 2006/0107468 | A1* | 5/2006 | Urbanet | D06F 39/003 8/158 |
| 2007/0113595 | A1* | 5/2007 | Harwood | D06F 33/02 68/12.01 |
| 2007/0283508 | A1* | 12/2007 | Wong | D06F 35/006 8/149.3 |
| 2008/0244836 | A1* | 10/2008 | Kim | D06F 33/02 8/159 |
| 2008/0282479 | A1* | 11/2008 | Darby | D06F 39/003 8/159 |
| 2008/0297099 | A1 | 12/2008 | Maekawa | |
| 2010/0064445 | A1* | 3/2010 | Nieh | D06F 35/006 8/159 |
| 2011/0247145 | A1* | 10/2011 | Chanda | D06F 33/02 8/137 |
| 2012/0005840 | A1* | 1/2012 | Jang | D06F 33/02 8/137 |
| 2012/0324654 | A1* | 12/2012 | Koo | D06F 37/304 8/137 |
| 2013/0081431 | A1* | 4/2013 | Hill | D06F 39/083 68/12.05 |
| 2013/0305462 | A1* | 11/2013 | Gasparini | D06F 33/02 8/137 |

FOREIGN PATENT DOCUMENTS

| | | | |
|---|---|---|---|
| KR | 20000010514 | A | 2/2000 |
| KR | 100930896 | B1 | 12/2009 |

* cited by examiner

WASHING MACHINE AND CONTROL METHOD THEREOF

CROSS-REFERENCE TO RELATED APPLICATION

This application claims priority under 35 U.S.C. § 119 to Korean Patent Application No. 10-2014-0020663, filed on Feb. 21, 2014, which is incorporated herein by reference in its entirety.

BACKGROUND

Field

The present disclosure relates to a washing machine and a control method thereof and, more particularly, to a washing machine using a circulation pump as a flow meter and a control method thereof.

Background

Generally, a laundry treatment apparatus commonly designates various kinds of apparatuses for treating laundry using physical and chemical actions, such as a washing machine for removing contaminants from clothing, bedding, etc. (hereinafter, referred to as 'laundry') using a chemical decomposition action of water and detergent and a physical action, such as friction, between water and laundry, a drying machine for spin-drying wet laundry to dry the wet laundry, and a refresher for spraying heated steam to laundry to prevent allergy due to the laundry and to conveniently wash the laundry.

A washing machine, which is a kind of laundry treatment apparatus, may be classified as an agitator type washing machine, a drum type washing machine, or a pulsator type washing machine according to the structure and washing method thereof. In general, the washing machine sequentially performs a washing cycle, a rinsing cycle, and a spin-drying cycle to wash laundry. Some of the cycles may be performed according to user selection. A proper washing method is used to wash laundry according to the kind of the laundry.

In conventional washing machines, however, an additional flow meter is mounted on a flow channel to measure flow rate of wash water supplied to the washing machine.

SUMMARY

Therefore, the present disclosure has been made in view of the above problems, and it is an object of the present disclosure to use a circulation pump as a flow meter for measuring flow rate of water.

It is another object to measure an amount of wash water contained in laundry.

It is a further object to provide a washing machine that automatically senses the kind of laundry so as to perform different cycles based thereon.

In accordance with an aspect of the present disclosure, the above and other objects can be accomplished by the provision of a control method of a washing machine including an outer tub, an inner tub disposed in the outer tub for receiving laundry, a water supply unit for supplying wash water to a space defined between the inner tub and the outer tub, and a circulation pump for supplying wash water discharged from the outer tub to the inner tub, the control method including (a) supplying wash water through the water supply unit without wetting the laundry, (b) driving the circulation pump to supply wash water discharged from the outer tub to the inner tub, (c) integrating the number of rotations of the circulation pump, (d) measuring current supplied to the circulation pump during driving of the circulation pump, (e) stopping driving of the circulation pump when the measured current value is decreased to a predetermined reference value or less, and (f) calculating the amount of wash water supplied by the circulation pump based on the number of rotations of the circulation pump.

The control method may further include (g) sensing a level of the wash water in the outer tub through a water level sensing unit after step (e), and (h) calculating the amount of wash water absorbed by the laundry placed in the inner tub based on the amount of the wash water supplied by the circulation pump calculated at step (f) and a value sensed by the water level sensing unit at step (g). In addition, the control method may further include (i) calculating an amount of the laundry placed in the inner tub before wash water is supplied into the inner tub, and (j) calculating a ratio of the amount of the wash water absorbed by the laundry to the amount of the laundry based on the amount of the wash water absorbed by the laundry calculated at step (h) and the amount of the laundry calculated at step (i). In addition, the control method may further include (k) further supplying wash water into the outer tub through the water supply unit and washing the laundry according to rotation of the inner tub, and (l) rotating the inner tub at a high speed to spin-dry the laundry.

A time for which the inner tub is rotated at step (l) may be set based on the ratio of the amount of the wash water absorbed by the laundry to the amount of the laundry calculated at step (j). In particular, the time for which the inner tub is rotated at step (l) may be set to increase as the ratio of the amount of the wash water absorbed by the laundry to the amount of the laundry becomes high.

A speed at which the inner tub is rotated at step (l) may be set based on the ratio of the amount of the wash water absorbed by the laundry to the amount of the laundry calculated at step (j). In particular, the speed at which the inner tub is rotated at step (l) may be set to increase as the ratio of the amount of the wash water absorbed by the laundry to the amount of the laundry becomes high.

Step (k) may include controlling water to be supplied through the water supply unit for a predetermined time based on the ratio of the amount of the wash water absorbed by the laundry to the amount of the laundry calculated at step (j).

Step (g) may be carried out when a predetermined time elapses after the operation of the circulation pump is stopped.

In accordance with another aspect of the present invention, there is provided a washing machine including an outer tub, an inner tub disposed in the outer tub for receiving laundry, a water supply unit for supplying wash water to a space defined between the inner tub and the outer tub, a circulation pump for supplying wash water discharged from the outer tub to the inner tub, a current measurement unit for measuring a current value supplied to the circulation pump, and a controller for controlling wash water to be supplied through the water supply unit without wetting the laundry placed in the inner tub, driving the circulation pump, stopping driving of the circulation pump when the current value measured by the current measurement unit is decreased to a predetermined reference value or less during driving of the circulation pump, and calculating the amount of wash water supplied by the circulation pump based on the number of rotations of the circulation pump integrated until the driving of the circulation pump is stopped.

The washing machine may further include a water level sensing unit for sensing a level of the wash water in the outer tub, wherein the controller may calculate the amount of wash water absorbed by the laundry placed in the inner tub based on the amount of the wash water supplied by the circulation pump and a value sensed by the water level sensing unit after the operation of the circulation pump is stopped.

The controller may calculate an amount of the laundry placed in the inner tub before wash water is supplied into the inner tub and calculate a ratio of the amount of the wash water absorbed by the laundry to the amount of the laundry based on the amount of the wash water absorbed by the laundry and the amount of the laundry. The controller may control the water supply unit to further supply wash water into the outer tub, perform a washing cycle, and perform a spin-drying cycle for rotating the inner tub at a high speed to spin-dry the laundry after the washing cycle.

A time for which the inner tub is rotated during the spin-drying cycle may be set based on the ratio of the amount of the wash water absorbed by the laundry to the amount of the laundry. In particular, the time for which the inner tub is rotated during the spin-drying cycle may be set to increase as the ratio of the amount of the wash water absorbed by the laundry to the amount of the laundry becomes high.

A speed at which the inner tub is rotated during the spin-drying cycle may be set based on the ratio of the amount of the wash water absorbed by the laundry to the amount of the laundry. In particular, the speed at which the inner tub is rotated during the spin-drying cycle may be set to increase as the ratio of the amount of the wash water absorbed by the laundry to the amount of the laundry becomes high.

The controller may control water to be supplied through the water supply unit for a predetermined time based on the ratio of the amount of the wash water absorbed by the laundry to the amount of the laundry.

The washing machine may further include a pulsator rotatably provided at the bottom of the inner tub, wherein the controller may control the water supply unit to supply water without immersing the pulsator.

BRIEF DESCRIPTION OF THE DRAWINGS

The embodiments will be described in detail with reference to the following drawings in which like reference numerals refer to like elements wherein.

DETAILED DESCRIPTION

Advantages, features, and methods for achieving those of embodiments may become apparent upon referring to embodiments described later in detail together with attached drawings. However, embodiments are not limited to the embodiments disclosed hereinafter, but may be embodied in different modes. The same reference numbers may refer to the same elements throughout the specification.

Figure 1:
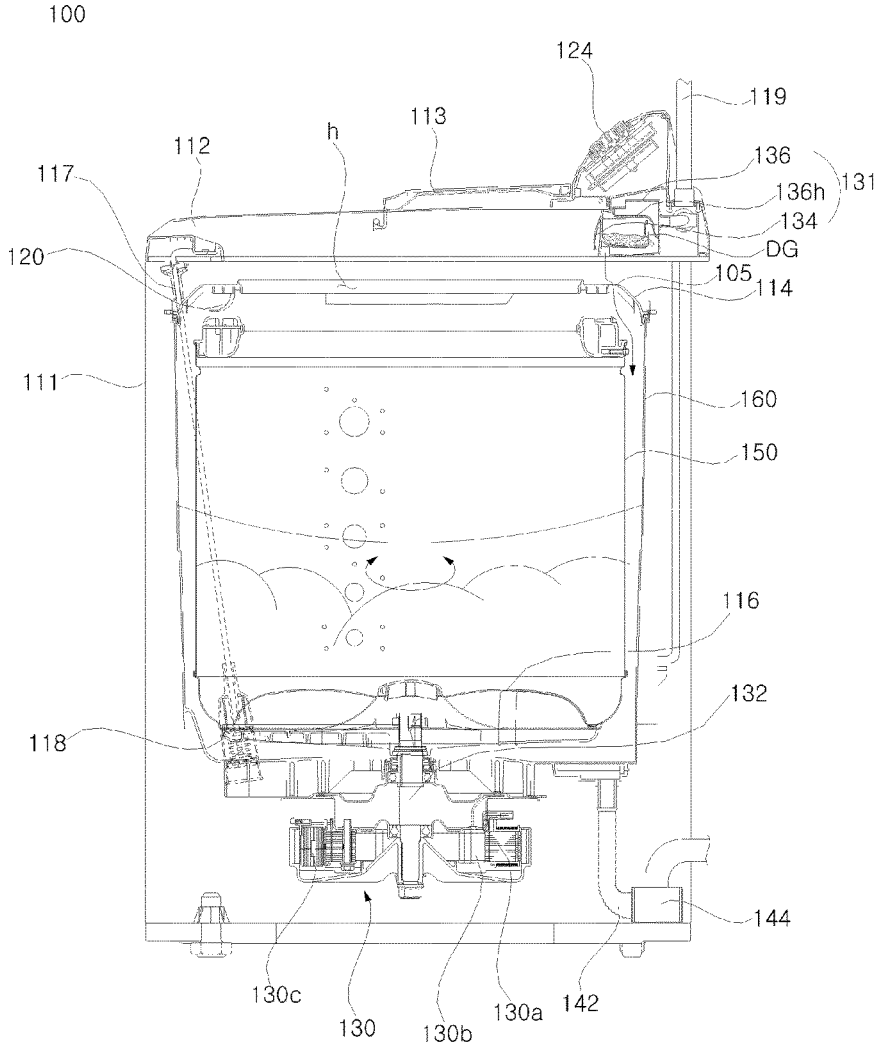
FIG. 1 is a side sectional view showing a washing machine according to an embodiment of the present invention.
Figure 2:
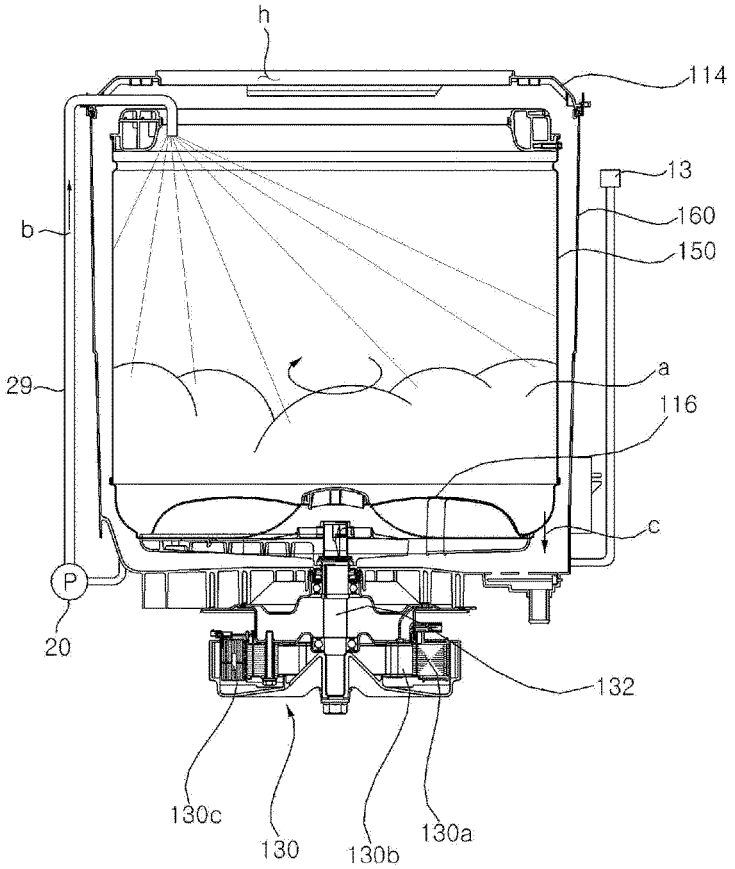
FIG. 2 is a view showing the flow of wash water caused by a circulation pump according to an embodiment of the present invention.
Figure 3:
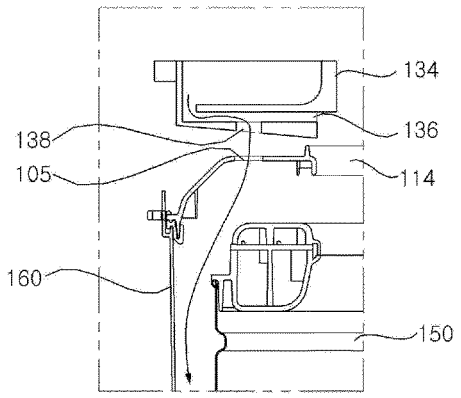
FIG. 3 is a partial view showing the construction of a water supply unit according to an embodiment of the present invention.

FIG. 1 is a side sectional view showing a washing machine according to an embodiment of the present invention. FIG. 2 is a view showing the flow of wash water caused by a circulation pump according to an embodiment of the present invention. FIG. 3 is a partial view showing the construction of a water supply unit according to an embodiment of the present invention.

Referring to FIGS. 1 to 3, a washing machine 100 according to an embodiment of the present invention includes an outer tub 160, an inner tub 150 disposed in outer tub 160 for receiving laundry, a water supply unit 131 for supplying wash water to a space defined between inner tub 150 and outer tub 160, and a circulation pump 20 for supplying the wash water discharged from outer tub 160 to inner tub 150.

Washing machine 100 may further include a cabinet 111 forming the external appearance thereof, the cabinet 111 being open at the top thereof, a cabinet cover 112 disposed at the open top of cabinet 111, the cabinet cover 112 having a laundry introduction port, through which laundry is introduced into or removed from inner tub 150, and a door 113 for opening and closing the laundry introduction port. Outer tub 160 may be suspended in cabinet 111 via a support member 117 such that impact applied to outer tub 160 is absorbed by a damper 118.

Inner tub 150 may be rotated about a vertical axis. The inner tub 150 is provided at the bottom thereof with an opening communicating with outer tub 160. At a cylindrical side of the inner tub 150 extending upward from the bottom is formed a plurality of small holes communicating with outer tub 160. Consequently, wash water flows between the inner tub 150 and the outer tub 160 through the opening and the small holes.

At the bottom of inner tub 150 may be provided a pulsator 116 for forming a water current in wash water. At the lower side of the outer tub 160 may be provided a main motor 130 for generating rotational force to rotate the inner tub 150 and/or the pulsator 116.

Main motor 130 includes a stator 130*a* having coils wound thereon and a rotor 130*b* configured to rotate through electromagnetic interaction with the stator coils. The stator 130*a* may have a plurality of coils wound thereon and internal resistance. The rotor 130*b* may have a plurality of magnets for inducing electromagnetic interaction with the coils. A rotary shaft 132 is rotated along with the rotor 130*b* to rotate the inner tub 150 and/or the pulsator 116.

Main motor 130 may have a hall sensor 130*c* for measuring the position of rotor 130*b*. Hall sensor 130*c* may generate an ON/OFF signal according to the rotation of rotor 130*b*. A controller 10 (see FIG. 4) of the washing machine 100 may estimate the rotational speed and position of the rotor based on the ON/OFF signal generated by hall sensor 130*c*.

Washing machine 100 may further include a water supply unit 131 for supplying wash water into outer tub 160. Water supply unit 131 may include a water supply valve 15 (see FIG. 4) for regulating a water supply hose 119, a detergent box 134 for receiving detergent DG, and a detergent box housing 136, in which the detergent box 134 is disposed such that the detergent box 134 can be drawn out from detergent box housing 136.

Detergent box housing 136 may be disposed in cabinet cover 112. Detergent box housing 136 may have a distribution hole 136*h*, through which wash water introduced from water supply hose 119 is distributed to detergent box 134. Detergent box 134 and detergent box housing 136 may be disposed at cabinet cover 112. Additionally, a control panel 124 may be further provided at cabinet cover 112. A user may input various commands for controlling washing machine 100 through control panel 124.

Water supply unit 131 supplies wash water into a space defined between inner tub 150 and outer tub 160. Wash water may be supplied into the space between inner tub 150 and outer tub 160 via detergent box 134. It is necessary for the wash water to be supplied to an extent that the laundry placed in inner tub 150 is not wetted by the wash water. For example, when the supply of the wash water is completed, the level of the wash water in outer tub 160 must be lower than the bottom of inner tub 150 or than the level of the wash water in inner tub 150 at which pulsator 116 is immersed in the wash water. Additionally, it is advantageous for the level of the wash water in outer tub 160 to be lower than the height of the small holes formed at the side of inner tub 150.

Water supply unit 131 supplies wash water having passed through detergent box 134 into the space between inner tub 150 and outer tub 160. Outer tub 160 is provided at the top thereof with an outer tub cover 114 having a laundry introduction hole h, through which laundry is introduced into inner tub 150 or removed from inner tub 150. In this case, a water supply port 105, through which the wash water supplied from water supply unit 131 passes, may be formed at the outer tub cover 114.

A drainage hose 142 and a drainage pump 144 may be provided to drain the wash water from outer tub 160. When drainage pump 144 is driven, the wash water is discharged from the outer tub 160 through drainage hose 142.

Circulation pump 20 feeds the wash water discharged from outer tub 160 to inner tub 150. Circulation pump 20 may be provided on a circulation channel 29 communicating with the outer tub 160. Circulation channel 29 may extend vertically. In this case, the wash water is pumped upward along circulation channel 29 by circulation pump 20 and is then resupplied to inner tub 150.

Circulation pump 20 may include an impeller (not shown) and a pump motor 21 (see FIG. 4) for rotating the impeller. As the impeller is rotated, the wash water is fed along circulation channel 29. At this time, the wash water in outer tub 160 is continuously introduced into circulation pump 20. Pump motor 21 may be a servo motor, the number of rotations and rotational angle of which can be controlled. Alternatively, pump motor 21 may be a normal motor including an encoder 23. Encoder 23 senses the number of rotations of the pump motor 21. Encoder 23 may be an optical encoder using a light emitting element and a light receiving element or a magnetic encoder using a magnet and a hall sensor.

An inverter 25 for supplying current to the pump motor 21 may be provided. Inverter 25 may vary voltage and frequency applied to pump motor 21 to control the speed of the pump motor 21. A current measurement unit 27 for measuring current supplied from inverter 25 to pump motor 21 may be further provided.

While pump motor 21 is being controlled to be rotated at a predetermined speed, the current supplied to the pump motor 21 varies depending upon the size of load. Consequently, it is possible to estimate a state of load applied to the pump motor 21 based on a current value measured by current measurement unit 27. While the wash water is being fed along circulation channel 29, the wash water appears to the pump motor 21 as a load. In this case, it is assumed that pump motor 21 is operated in a loaded state. The current value measured by current measurement unit 27 during operation of pump motor 21 in the loaded state is greater than that measured by current measurement unit 27 during operation of pump motor 21 in a non-load state, in which no wash water is introduced into circulation pump 20. Consequently, the controller 10 may estimate the change of the load applied to pump motor 21 based on the change of the current value measured by current measurement unit 27 during operation of pump motor 21. For example, in a case in which a current value of a substantially uniform size is measured by current measurement unit 27 and then the current value is lower than a predetermined reference value at a specific time, controller 10 may determine that the level of wash water in outer tub 160 is zero at the time when the current value is lower than the reference value.

Meanwhile, washing machine 100 may further include a sensing unit for sensing the number of rotations of pump motor 21. In the following description, the sensing unit is an encoder 23 for detecting the number of rotations of pump motor 21. However, the present invention is not limited thereto.

Pump motor 21 may generate a plurality of pulse signals having different phases during rotation thereof. Encoder 23 may sense not only the number of rotations of pump motor 21 but also the rotational direction of the rotary shaft based on a phase difference between the pulse signals. Encoder 23 senses the rotational direction of the rotary shaft based on the number of pulses generated per second. Encoder 23 may also estimate the position of the rotary shaft based on the pulse signals.

Controller 10 may sense a time at which load has been changed (for example, a time at which the state of the pump motor 21 has been switched from the loaded state to the non-load state) based on the current measured by current measurement unit 27. In a state in which the level of the wash water in outer tub 160 is very low (for example, pulsator 116 is not immersed in the wash water), pump motor 21 is operated to supply the wash water from outer tub 160 into inner tub 150 via circulation channel 29. Most of the wash water supplied into inner tub 150 is absorbed by the laundry in the inner tub 150, although an absorption degree of the wash water varies depending upon the amount or properties of the laundry placed in inner tub 150, and some of the wash water is reintroduced into outer tub 160. A current value, I, measured by current measurement unit 27 when wash water is introduced into inner tub 150 from outer tub 160 by circulation pump 20 and then some of the wash water which is not absorbed by the laundry is discharged from inner tub 150 to outer tub 160 has the following change tendency.

For a predetermined time after the operation of pump motor 21 is commenced, the current value I is gradually decreased in response to the load which is reduced as the level of the wash water in outer tub 160 becomes low. As pump motor 21 is continuously operated, the current value I may be greatly decreased at a specific time. This is because the load applied to pump motor 21 varies abruptly.

More specifically, since circulation pump 20 is operated in a state in which the level of the wash water in outer tub 160 is very low, all of the wash water in the outer tub 160 is rapidly fed along circulation channel 29. However, it may take some time until the wash water supplied into inner tub 150 through circulation channel 29 passes through the laundry and is then discharged to outer tub 160. For this reason, pump motor 21 is operated in the non-load state until the wash water is discharged from inner tub 150 to outer tub 160. Since the current value measured by the current measurement unit 27 in a state in which pump motor 21 is operated in the loaded state is quite different from that measured by the current measurement unit 27 in a state in which pump motor 21 is operated in the non-load state, controller 10 may determine that the level of the wash water in outer tub 160 is zero at the time when the current value, I, is remarkably decreased and calculate the number of rotations of pump motor 21 integrated until that time based on the sensed value of encoder 23.

On the other hand, the wash water supplied into inner tub 150 through circulation channel 29 may be rapidly discharged into outer tub 160 according to the amount or material of the laundry placed in inner tub 150. Since the amount of the wash water introduced into outer tub 160 from inner tub 150 is merely a residual amount of the wash water excluding the amount of the wash water absorbed by the laundry, however, there exists a period in which the load applied to pump motor 21 varies greatly. As a result, the current value I measured by current measurement unit 27 is also greatly decreased at a specific time. Even in this case, therefore, controller 10 may calculate the number of rotations of pump motor 21 integrated until the time at which the current value I is greatly decreased.

According to these embodiments, controller 10 may sense a time at which the current value I measured by current measurement unit 27 is decreased to the reference value or less, and calculate the number of rotations of pump motor 21 integrated until that time. Additionally, controller 10 may stop the operation of pump motor 21 at the time at which the current value I measured by current measurement unit 27 is decreased to the reference value or less (or at the time at which the current value is greatly decreased).

Controller 10 may calculate the amount of the wash water (hereinafter, referred to as feed amount E) fed by circulation pump 20 based on the number of rotations of pump motor 21 integrated until the operation of the circulation pump motor 20 is stopped. The feed amount E calculated as described above is substantially equal to the amount of the wash water supplied into outer tub 160 by water supply unit 131.

Figure 4:
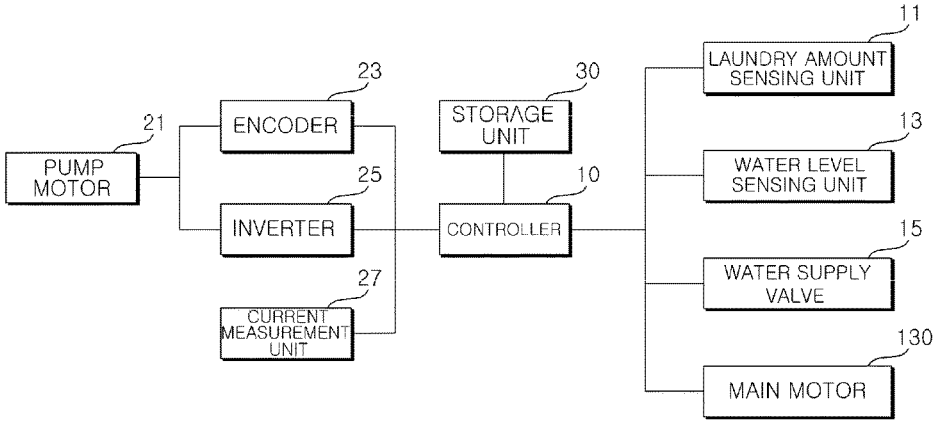
FIG. 4 is a block diaphragm of the washing machine according to the embodiment of the present invention.

Flow rate ($m^3$/rev) per rotation of the circulation pump 20 is a value set based on the specification of the circulation pump 20, which may be pre-stored in a storage unit 30 (see FIG. 4). Controller 10 may multiply the flow rate per rotation by the number of rotations accumulated based on the sensed value of encoder 23 to decide the feed amount E. That is, the feed amount E is calculated using the circulation pump 20 without the provision of an additional flow meter.

When a predetermined time elapses after the operation of circulation pump 20 is stopped, the level of the wash water in outer tub 160 is sensed. When the operation of circulation pump 20 is stopped, the wash water remaining in circulation channel 29 flows backward and is thus reintroduced into outer tub 160. As time passes, a predetermined amount of wash water is discharged from inner tub 150 to outer tub 160. That is, the total amount of the wash water (hereinafter, referred to as residual water amount R) collected in outer tub 160 after the operation of circulation pump 20 is stopped is the sum of the amount of the wash water (hereinafter, referred to as backward flow amount B) flowing backward through circulation channel 29 and the amount of wash water (hereinafter, referred to as discharge amount C) discharged from inner tub 150 to outer tub 160.

Washing machine 100 may further include a water level sensing unit 13 for sensing the level of the wash water in outer tub 160. Controller 10 may calculate the residual water amount R based on a sensed value of the water level sensing unit 13.

Water level sensing unit 13 may include a pressure sensor for sensing pneumatic pressure in a pipe communicating with the outer tub 160. The pneumatic pressure in the pipe varies according to the level of the wash water in the outer tub 160. Consequently, it is possible to calculate the level of the wash water in outer tub 160 based on a pressure value sensed by the pressure sensor.

Water level sensing unit 13 may include a membrane expanding and contracting in response to the pneumatic pressure in the pipe. Alternatively, water level sensing unit 13 may include a pressure sensor using a piezo-resistance effect of a semiconductor signal crystal. Alternatively, the water level sensing unit 13 may include a diaphragm and a deformable gauge resistor attached to the surface of the diaphragm such that a resistance value of the deformable gauge resistor can be varied as the deformable gauge resistor is also deformed when the diaphragm is deformed according to the pneumatic pressure in the pipe. Meanwhile, on the assumption that the amount of the wash water absorbed by the laundry placed in inner tub 150 is water holding amount A, the feed amount E is equal to the sum of the water holding amount A and the residual water amount R (where R=B+C). As discussed above, the feed amount E may be calculated based on driving information (supplied current value and the number of rotations) of pump motor 21, and the residual water amount R may be calculated based on the sensed value of the water level sensing unit 13. Consequently, the controller 10 may calculate the water holding amount A based on a difference between the feed amount E and the residual water amount R.

The backward flow amount B may be a value preset based on the capacity of circulation pump 20, the length of circulation channel 29, and the sectional area of circulation channel 29, etc. and may be stored in storage unit 30. Controller 10 may calculate the discharge amount C from a difference between the residual water amount R and the backward flow amount B.

Washing machine 100 may further include a laundry amount sensing unit 11 for sensing the amount of laundry placed in the inner tub 150 before wash water is supplied into inner tub 150. The amount of the laundry sensed at this time will hereinafter be referred to as dry laundry amount D since the amount of the laundry sensed at this time is a value sensed in a state in which the laundry is not wet. Controller 10 may calculate the amount of wash water held by unit laundry, i.e. a water holding rate P (=A/D), based on the dry laundry amount D and the water holding amount A. Controller 10 may set the amount of wash water to be supplied into inner tub 150 for washing or rinsing, a spin-drying time, a progressing time of a washing cycle (S80) (see FIG. 5), etc. based on the calculated water holding rate P.

Figure 5:
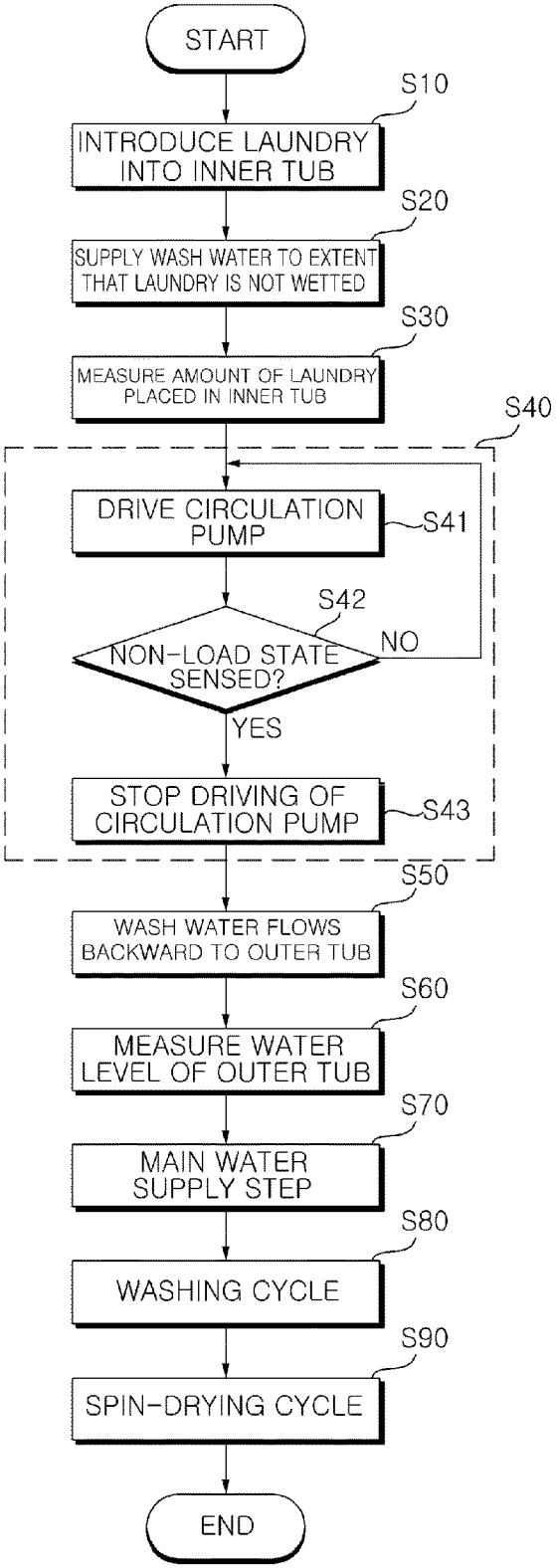
FIG. 5 is a flowchart showing a control method of a washing machine according to an embodiment of the present invention.

FIG. 4 is a block diaphragm of the washing machine according to the embodiment of the present invention. FIG. 5 is a flowchart showing a control method of the washing machine according to an embodiment of the present invention.

Referring to FIGS. 4 and 5, a control method of the washing machine 100 according to an embodiment of the present invention includes supplying wash water into a space defined between inner tub 150 and outer tub 160 to a water level at which laundry placed in the inner tub 150 is not wetted (S20), driving the circulation pump 20 (S41), sensing the change of a current value supplied to the circulation pump 20 (S42), accumulating the number of rotations of the circulation pump 20, stopping driving of the circulation pump 20 when the current value supplied to the circulation pump 20 is decreased to a predetermined reference value or less (S43), and calculating the amount of wash water fed by the circulation pump 20 based on the accumulated number of rotations.

More specifically, when laundry is introduced into inner tub 150 (S10) and then the operation of the washing machine 100 is performed, the supply of water is performed by water supply unit 131. Water supply unit 131 supplies wash water to the space between inner tub 150 and outer tub 160. The supply of water is performed by the water supply unit 131 to an extent that the laundry placed in inner tub 150 is not wetted.

When the supply of water is completed, the circulation pump 20 is driven to supply the wash water from outer tub 160 into inner tub 150 through circulation channel (S40: circulation step). The circulation step (S40) may include driving circulation pump 20 to feed wash water through circulation channel 29 (S41), sensing load applied to circulation pump 20 during driving of circulation pump 20 (S42), and stopping driving of the circulation pump 20 based on the sensed result at step S42 (S43).

At step S41, current is supplied to pump motor 21 such that the pump motor 21 is rotated while being maintained at a predetermined rotational speed. The current value supplied to the pump motor 21 is continuously sensed by current measurement unit 27.

At step S42, controller 10 may determine a time at which the load applied to pump motor 21 is greatly lowered based on the current value sensed by the current measurement unit 27. For example, when the current value sensed by the current measurement unit 27 is decreased to a predetermined reference value or less, controller 10 may determine that all the wash water contained in the outer tub 160 has been fed by circulation pump 20 and then stop operation of pump motor 21 (S43).

During driving of circulation pump 20, controller 10 may integrate the number of rotations of pump motor 21 and calculate the feed amount E based on the integrated number of rotations of pump motor 21.

Meanwhile, when the driving of the circulation pump 20 is stopped, the wash water remaining in the circulation channel 29 flows backward and is reintroduced into outer tub 160 (S50). As time passes, the wash water is also introduced into outer tub 160 from inner tub 150.

Subsequently, the level of the wash water in the outer tub 160 is sensed by water level sensing unit 13. Controller 10 may calculate the residual water amount R based on a sensed value of the water level sensing unit 13 and calculate the water holding amount A from a difference between the feed amount E and the residual water amount R.

Meanwhile, a step (S30) of sensing the amount of the laundry may be carried out before the circulation step (S40). An inertia moment of a load constituted by the inner tub 150 and the laundry varies based on the amount of laundry placed in the inner tub 150. Consequently, angular acceleration of inner tub 150 varies by the inertia moment and a current value supplied to the main motor 130 may be measured. Controller 10 may calculate the amount of the laundry based on the angular acceleration of inner tub 150 and the current value supplied to main motor 130. According to embodiments, the weight of inner tub 150 may be sensed to calculate the amount of the laundry. In addition, the amount of the laundry may be calculated using various well-known methods.

Meanwhile, in FIG. 5, the laundry placed in inner tub 150 is not wetted although the supply of water is performed at step S20. For this reason, the amount of the laundry is sensed after the step of supplying wash water (S20). However, the present invention is not limited thereto. For example, the amount of the laundry may be sensed before the step of supplying wash water (S20). Controller 10 may calculate the water holding rate P based on the water holding amount A and the laundry amount D.

At a main water supply step (S70), wash water necessary for a washing cycle (S80) is supplied. The amount of water supplied at the main water supply step (S70) may be set in consideration of the water holding rate P as well as the laundry amount. For example, controller 10 may control water supply unit 131 to supply much more wash water as the water holding rate P is higher.

After the main water supply step (S70), the washing cycle (S80) and a spin-drying cycle (S90) may be carried out. In particular, at the spin-drying cycle (S90), controller 10 rotates main motor 130 at a high speed to spin-dry the laundry. At the spin-drying cycle (S90), controller 10 may set a spin-drying time or a rotational speed of inner tub 150 or main motor 130 based on the water holding amount A or the water holding rate P. For example, controller 10 may increase the spin-drying time or the rotational speed of inner tub 150 as the water holding amount A becomes high. On the other hand, controller 10 may decrease the spin-drying time or the rotational speed of the inner tub 150 as the water holding amount A becomes low.

Meanwhile, controller 10 may set the amount of water supplied at the main water supply step (S70), the spin-drying time at the spin-drying cycle (S90), and a washing time at the washing cycle (S80) based on the water holding rate P. For example, in a case in which the water holding rate P is high although the laundry amount is uniform, it is necessary to separate much more wash water from the laundry. As the water holding rate P becomes high, therefore, controller 10 increases the spin-drying time or the rotational speed of inner tub 150 at the spin-drying cycle (S90).

In addition, controller 10 may control the amount of wash water supplied at the main water supply step (S70) based on the water holding rate P. For example, in a case in which the water holding rate P of the laundry is high although the laundry amount is uniform, a larger amount of wash water is needed to wash the laundry than in a case in which the water holding rate P of the laundry is low. As the water holding rate P becomes higher, therefore, controller 10 may control the water supply valve 15 to be open for a longer time at the main water supply step (S70). In another example, laundry having a high water holding rate P may be laundry made of cotton. In this case, it is necessary to wash the laundry using a high-concentration detergent, i.e. in a state in which a ratio of detergent to wash water is high. In this case, therefore, the opening time of the water supply valve 15 may be reduced when the water holding rate P is high.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A control method of a washing machine comprising an outer tub, an inner tub disposed in the outer tub for receiving laundry, a water supply unit for supplying wash water to a space defined between the inner tub and the outer tub, and a circulation pump for supplying wash water discharged from the outer tub to the inner tub, the control method comprising:

(a) supplying wash water through the water supply unit without wetting laundry placed in the inner tub;

(b) driving the circulation pump with a pump motor which rotates to supply wash water of the outer tub to the inner tub;

(c) accumulating the number of rotations of the pump motor of the circulation pump;

(d) measuring current supplied to the circulation pump during driving of the circulation pump;

(e) stopping driving of the circulation pump when the measured current value is at or below a predetermined reference value and maintaining driving of the circulation pump when the measured current value is above the predetermined reference value; and (f) calculating the amount of wash water supplied by the circulation pump based on the number of rotations of the pump motor of the circulation pump.

2. The control method of claim 1, further comprising:

(g) sensing a level of the wash water in the outer tub through a water level sensing unit after step (e); and (h) calculating the amount of wash water absorbed by the laundry placed in the inner tub based on the amount of the wash water supplied by the circulation pump calculated at step (f) and a value sensed by the water level sensing unit at step (g).

3. The control method of claim 2, further comprising:

(i0) rotating the inner tub placing laundry that is not wet with a main motor before step (b);

(i1) calculating, by a controller, an amount of the laundry that is not wet placed in the inner tub, the calculation being based on the angular acceleration of the inner tub and the current value supplied to the main motor for generating rotational force to rotate the inner tub at step (i0); and (j) calculating, by the controller, a ratio of the amount of the wash water absorbed by the laundry to the amount of the laundry that is not wet based on the amount of the wash water absorbed by the laundry calculated at step (h) and the amount of the laundry that is not wet calculated at step (i1).

4. The control method of claim 3, further comprising:

(k) further supplying wash water into the outer tub through the water supply unit to wet laundry and washing the laundry according to rotation of the inner tub; and (l) rotating the inner tub to spin-dry the laundry.

5. The control method according to claim 4, wherein a time for which the inner tub is rotated at step (l) is set based on the ratio of the amount of the wash water absorbed by the laundry to the amount of the laundry that is not wet calculated at step (j).

6. The control method of claim 5, wherein the time for which the inner tub is rotated at step (l) is set to increase as the ratio of the amount of the wash water absorbed by the laundry to the amount of the laundry that is not wet becomes high.

7. The control method of claim 4, wherein a speed at which the inner tub is rotated at step (l) is set based on the ratio of the amount of the wash water absorbed by the laundry to the amount of the laundry that is not wet calculated at step (j).

8. The control method of claim 7, wherein the speed at which the inner tub is rotated at step (l) is set to increase as the ratio of the amount of the wash water absorbed by the laundry to the amount of the laundry that is not wet becomes high.

9. The control method of claim 4, wherein step (k) comprises controlling water to be supplied through the water supply unit for a predetermined time based on the ratio of the amount of the wash water absorbed by the laundry to the amount of the laundry that is not wet calculated at step (j).

10. The control method of claim 2, wherein step (g) is carried out when a predetermined time elapses after the operation driving of the circulation pump is stopped.

11. A washing machine comprising:

an outer tub;

an inner tub disposed in the outer tub for receiving laundry;

a water supply unit for supplying wash water to a space defined between the inner tub and the outer tub;

a circulation pump including a pump motor which rotates for supplying wash water of the outer tub to the inner tub;

an encoder sensing the number of rotations of the pump motor;

a current measurement unit for measuring a current value supplied to the circulation pump; and a controller for controlling wash water to be supplied through the water supply unit without wetting the laundry placed in the inner tub, driving the circulation pump, stopping driving of the circulation pump when the current value measured by the current measurement unit is decreased to a predetermined reference value or less during driving of the circulation pump, and calculating the amount of wash water supplied by the circulation pump based on the number of rotations of the pump motor of the circulation pump sensed by encoder accumulated until the driving of the circulation pump is stopped.

12. The washing machine of claim 11, further comprising:

a water level sensing unit for sensing a level of the wash water in the outer tub, wherein the controller calculates the amount of wash water absorbed by the laundry placed in the inner tub based on the amount of the wash water supplied by the circulation pump and a value sensed by the water level sensing unit after the operation of the circulation pump is stopped.

13. The washing machine of claim 12, further comprising:

a main motor for rotating the inner tub, wherein the controller calculates an amount of the laundry that is not wet placed in the inner tub before driving the circulation pump, the calculation being based on the angular acceleration of the inner tub and the current value supplied to the main motor for generating rotational force to rotate the inner tub, and then calculates a ratio of the amount of the wash water absorbed by the laundry to the amount of the laundry that is not wet based on the amount of the wash water absorbed by the laundry and the amount of the laundry that is not wet.

14. The washing machine of claim 13, wherein the controller controls the water supply unit to further supply wash water into the outer tub after calculating the ratio of the amount of the wash water absorbed by the laundry to the amount of the laundry that is not wet, performs a washing cycle, and performs a spin-drying cycle for rotating the inner tub to spin-dry the laundry after the washing cycle.

15. The washing machine of claim 14, wherein a time for which the inner tub is rotated during the spin-drying cycle is set based on the ratio of the amount of the wash water absorbed by the laundry to the amount of the laundry that is not wet.

16. The washing machine of claim 15, wherein the time for which the inner tub is rotated during the spin-drying cycle is set to increase as the ratio of the amount of the wash water absorbed by the laundry to the amount of the laundry that is not wet becomes high.

17. The washing machine of claim 14, wherein a speed at which the inner tub is rotated during the spin-drying cycle is set based on the ratio of the amount of the wash water absorbed by the laundry to the amount of the laundry that is not wet.

18. The washing machine of claim 17, wherein the speed at which the inner tub is rotated during the spin-drying cycle is set to increase as the ratio of the amount of the wash water absorbed by the laundry to the amount of the laundry that is not wet becomes high.

19. The washing machine of claim 14, wherein the controller controls water to be supplied through the water supply unit for a predetermined time based on the ratio of the amount of the wash water absorbed by the laundry to the amount of the laundry that is not wet.

20. The washing machine of claim 11, further comprising:

a pulsator rotatably provided at a bottom of the inner tub, wherein the controller controls the water supply unit to supply water without immersing the pulsator.

* * * * *